US008727333B2

(12) United States Patent
Ohmiya

(10) Patent No.: US 8,727,333 B2
(45) Date of Patent: May 20, 2014

(54) PRINTING APPARATUS AND PROGRAM

(71) Applicant: Takashi Ohmiya, Nagoya (JP)

(72) Inventor: Takashi Ohmiya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/747,628

(22) Filed: Jan. 23, 2013

(65) Prior Publication Data

US 2013/0187325 A1 Jul. 25, 2013

(30) Foreign Application Priority Data

Jan. 23, 2012 (JP) ..... 2012-010696

(51) Int. Cl.
*B65H 3/44* (2006.01)
*B65H 5/26* (2006.01)

(52) U.S. Cl.
USPC ..... 271/9.01; 271/3.14; 271/279; 271/298; 358/404; 358/426.05; 358/444; 358/409; 358/486; 358/488; 358/498; 358/1.16; 358/1.17; 399/388; 399/391; 399/397; 399/403; 399/405

(58) Field of Classification Search
USPC ..... 271/9.01, 3.14, 279, 298
See application file for complete search history.

(56) References Cited

U.S. PATENT DOCUMENTS

| | | | | |
|---|---|---|---|---|
| 8,167,308 | B2 * | 5/2012 | Tanaka | 271/298 |
| 2004/0130088 | A1 * | 7/2004 | Sato et al. | 271/3.14 |
| 2010/0156024 | A1 * | 6/2010 | Tanaka | 271/3.14 |

FOREIGN PATENT DOCUMENTS

| | | |
|---|---|---|
| JP | A-H01-306249 | 12/1989 |
| JP | 6-24589 | 2/1994 |
| JP | 2008-230818 | 10/2008 |
| JP | 2011-145569 | 7/2011 |

* cited by examiner

*Primary Examiner* — Prasad Gokhale
(74) *Attorney, Agent, or Firm* — Scully, Scott, Murphy & Presser, PC

(57) ABSTRACT

There is provided a printing apparatus including a sheet accommodation device including at least one sheet accommodation section which accommodates a sheet before printing, a printing unit which prints an image on a sheet based on print data stored in a storage area, a discharged sheet accommodation device including at least one discharged sheet accommodation section which accommodates the printed sheet, a control device which selects a combination of a sheet accommodation section and a discharged sheet accommodation section such that a storage device completes storing print data into the storage area by a conveyance starting time of a sheet to be printed based on the print data, and which control a conveyance device to feed the sheet to be printed based on the print data from the sheet accommodation section to discharge the sheet to the discharged sheet accommodation section of the selected combination.

12 Claims, 8 Drawing Sheets

*FIG. 4*

| | NORMAL SHEET DISCHARGE TRAY | OPTIONAL SHEET DISCHARGE TRAY |
|---|---|---|
| NORMAL SHEET FEEDING TRAY | 3 | 4 |
| FIRST OPTIONAL SHEET FEEDING TRAY | 4 | 4 |
| SECOND OPTIONAL SHEET FEEDING TRAY | 4 | 5 |
| THIRD OPTIONAL SHEET FEEDING TRAY | 5 | 5 |

PRINTING APPARATUS AND PROGRAM

CROSS-REFERENCE TO RELATED APPLICATION

This application claims priority from Japanese Patent Application No. 2012-010696, filed on Jan. 23, 2012, the entire subject matter of which is incorporated herein by reference.

TECHNICAL FIELD

Aspects of the present invention relate to a printing apparatus which prints an image on a sheet, and a program, and more specifically, to a printing apparatus which performs continuous printing while a plurality of sheets remaining in a sheet conveyance path, and a program.

BACKGROUND

There has been known a technique about a printing apparatus which continuously prints print data of a plurality of pages stored in a memory of the apparatus while a plurality of sheets remaining in a sheet conveyance path from a feeder unit to a sheet discharge unit (for example, see JP-A-H01-306249). Also, in order to perform a recovery print, a printing apparatus holds print data until a sheet having a print data image printed thereon is discharged, and erases the print data on a condition that discharge of the sheet is completed.

However, the related-art printing apparatus has a following problem, and there is a room for improvement on sheet conveyance when print data of the maximum number of pages is stored in the memory of the apparatus.

For example, assuming a printing apparatus which can store print data of four pages in a memory and perform printing while up to five sheets remaining in a sheet conveyance path, i.e., can convey up to five sheets simultaneously, when print data from a first page to a fourth page is already stored in the memory, the apparatus does not start feeding a sheet for print data of a fifth page until at least, print and sheet discharge of the first page are completed and storing of print data of a fifth page into the memory is completed, so as to prevent a situation (so-called overrun) where a sheet reaches a process unit at a state where the storing of the print data is incomplete. That is, although the fifth sheet can be conveyed, the feed of the sheet for the print data of the fifth page is delayed until the storing of the print data of the fifth page into the memory is completed. Therefore, it is difficult to perform a print job at the maximum speed, so that a sufficient printing capability would not be achieved.

SUMMARY

Accordingly, an aspect of the present invention provides a printing apparatus and a program capable of preventing printing speed from being lowered while avoiding an overrun.

According to an illustrative embodiment of the present invention, there is provided a printing apparatus comprising: a storage device, a sheet accommodation device, a printing device, a discharged sheet accommodation device, a conveyance device, and a control device. The storage device includes a storage area configured to store therein print data of a predetermined number of pages. The sheet accommodation device includes at least one sheet accommodation section configured to accommodate therein a plurality of sheets before printing. The printing device is configured to print an image on a sheet based on the print data stored in the storage area. The discharged sheet accommodation device includes at least one discharged sheet accommodation section configured to accommodate the sheet on which the image has been printed by the printing device. The conveyance device is configured to convey a sheet from the sheet accommodation device to the discharged sheet accommodation device via the printing device. The control device is configured to select an execution combination of a usable one of the at least one sheet accommodation section and a usable one of the at least one discharged sheet accommodation section such that the storage device completes storing print data into the storage area by a conveyance starting time of a sheet to be printed based on the print data, and not select a combination of one of the at least one sheet accommodation section and one of the at least one discharged sheet accommodation section, with which the storage device does not complete storing the print data into the storage area by the conveyance starting time of the sheet to be printed based on the print data, when making a selection on at least one of the sheet accommodation device and the discharged sheet accommodation device; and control the conveyance device to feed the sheet to be printed based on the print data from the sheet accommodation section of the selected execution combination to the discharged sheet accommodation section of the selected execution combination, on a condition that the storage device completes storing the print data in the storage area According to another illustrative embodiment of the present invention, there is provided a non-transitory storage medium having a computer program stored thereon and readable by a computer of a print control apparatus for controlling a printing apparatus, the computer program, when executed by the computer, causing the computer to operate as a selection unit and an instruction unit. The selection unit is configured to enable to select an execution combination of a usable one the at least one sheet accommodation section and a usable one of the at least one discharged sheet accommodation section such that the printing apparatus completes storing print data into a storage area of the printing apparatus by a conveyance starting time of a sheet to be printed based on the print data and disable to select a combination of one of the at least one sheet accommodation section and one of the at least one discharged sheet accommodation section, with which the printing apparatus does not complete storing the print data into the storage area by the conveyance starting time of the sheet to be printed based on the print data. The instruction unit configured to instruct the printing apparatus to use the sheet accommodation section of the selected execution combination and the discharged sheet accommodation section of the selected execution combination.

According to the above configuration, it is possible to implement the printing apparatus and program capable of preventing printing speed from being lowered while avoiding the overrun.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIG. 4 shows a configuration of a maximum sheet number table defining the maximum number of sheets which can be conveyed simultaneously;

DETAILED DESCRIPTION

Hereinafter, an illustrative embodiment of the printing apparatus of the invention will be specifically described with reference to the accompanying drawings. In the illustrative embodiment, an electrophotographic type printer capable of providing an optional sheet feeding tray and an optional sheet discharge tray will be exemplified.

[Overall Configuration of Printer]

Figure 1:
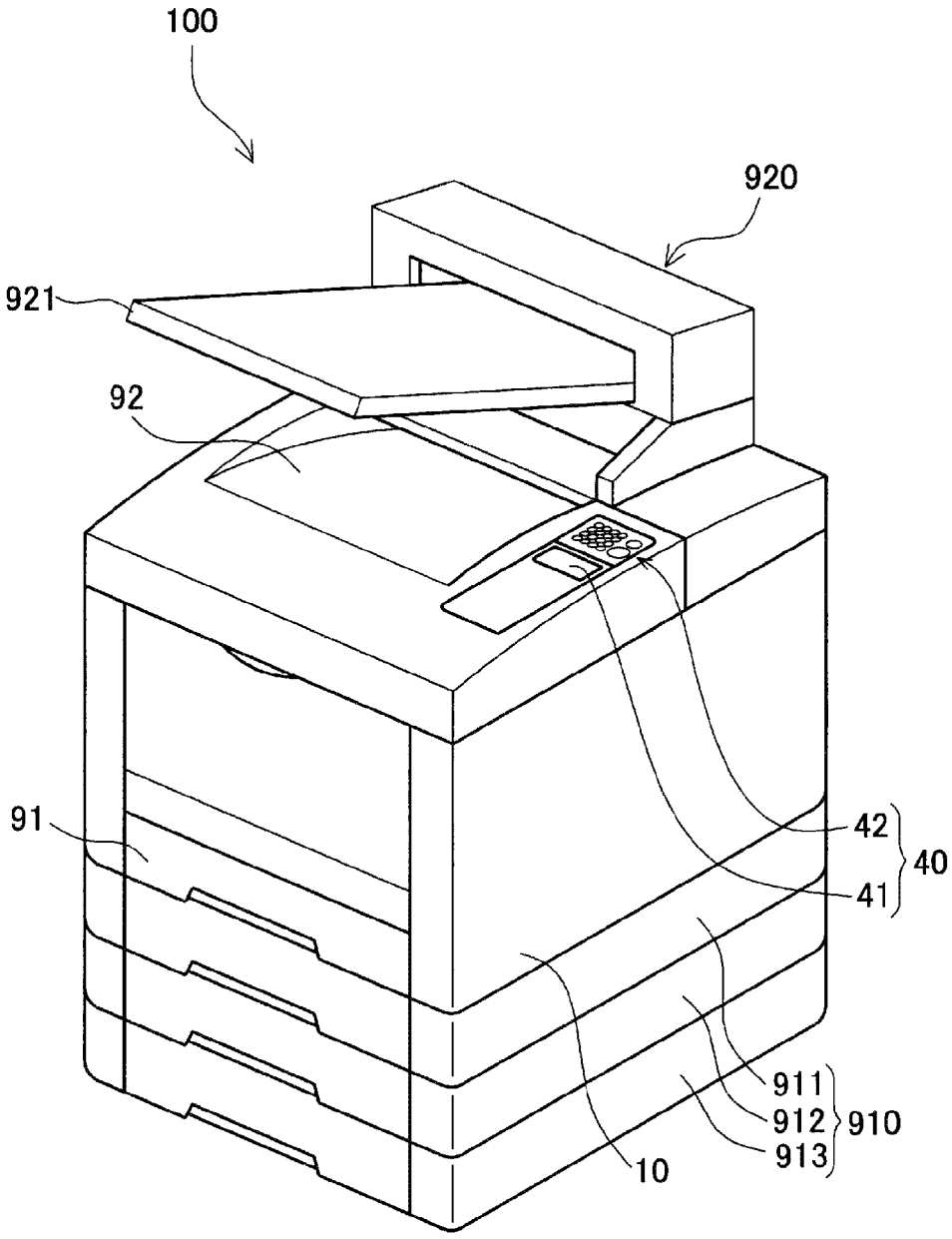
FIG. 1 is a perspective view showing an outer appearance of a printer according to an illustrative embodiment of the invention.

As shown in FIG. 1, a printer 100 of this illustrative embodiment includes a main body unit 10 which performs printing on a sheet, an additional feeder unit 910 (an example of a sheet accommodation device or a sheet accommodation section) having at least one sheet feeding tray which accommodates a sheet before a printing in the main body unit 10 and an additional sheet discharge unit 920 (an example of a discharged sheet accommodation device or a discharged sheet accommodation section) having at least one sheet discharge tray which accommodates a sheet after the printing in the main body unit 10. The main body unit 10 accommodates therein a process cartridge which is a print engine. The extension feeder unit 910 is detachably attached to a lower surface of the main body unit 10. The additional sheet discharge unit 920 is detachably attached to an upper surface of the main body unit 10.

The main body unit 10 has, at its bottom, a sheet feeding tray 91 (hereinafter, which is referred to as 'normal sheet feeding tray 91' so as to distinguish from the additional feeder unit 910 and which is an example of a sheet accommodation device or a sheet accommodation section) accommodating a sheet before the printing such that a printing surface of the sheet is directed upward. Also, the main body unit 10 has, at its upper surface, a sheet discharge tray 92 (hereinafter, which is referred to as 'normal sheet discharge tray 92' so as to distinguish from the additional sheet discharge unit 920 and which is an example of a discharged sheet accommodation device or a discharged sheet accommodation section) loading a discharged sheet (printed sheet) thereon such that a printed surface of the sheet is directed downward.

Also, an upper surface of the main body unit 10 is provided with an operation panel 40 having a display unit 41 configured by a liquid crystal monitor and a button group 42 including an OK button, a cancel button, a ten key, a user authentication button and the like. By using the operation panel 40, it is possible to display an operating status and to enable a user to input an instructional operation.

The printer 100 shown in FIG. 1 has a three-stage sheet feeding tray group as the additional feeder unit 910. In this illustrative embodiment, the respective sheet feeding trays configuring the sheet feeding tray group are sequentially referred to as a first optional sheet feeding tray 911, a second optional sheet feeding tray 912 and a third optional sheet feeding tray 913, from the above. In the meantime, the additional feeder unit 910 is not limited to the three-stage sheet feeding tray group. That is, the additional feeder unit 910 may have two or smaller stages or four or larger stages.

Also, the printer 100 shown in FIG. 1 has one-stage optional sheet discharge tray 921 as the additional sheet discharge unit 920. In the meantime, the additional sheet discharge unit 920 is not limited to the one-stage sheet discharge tray. That is, the additional sheet discharge unit 920 may include a plurality of stages, like the additional feeder unit 910.

[Internal Configuration of Printer]

Figure 2:
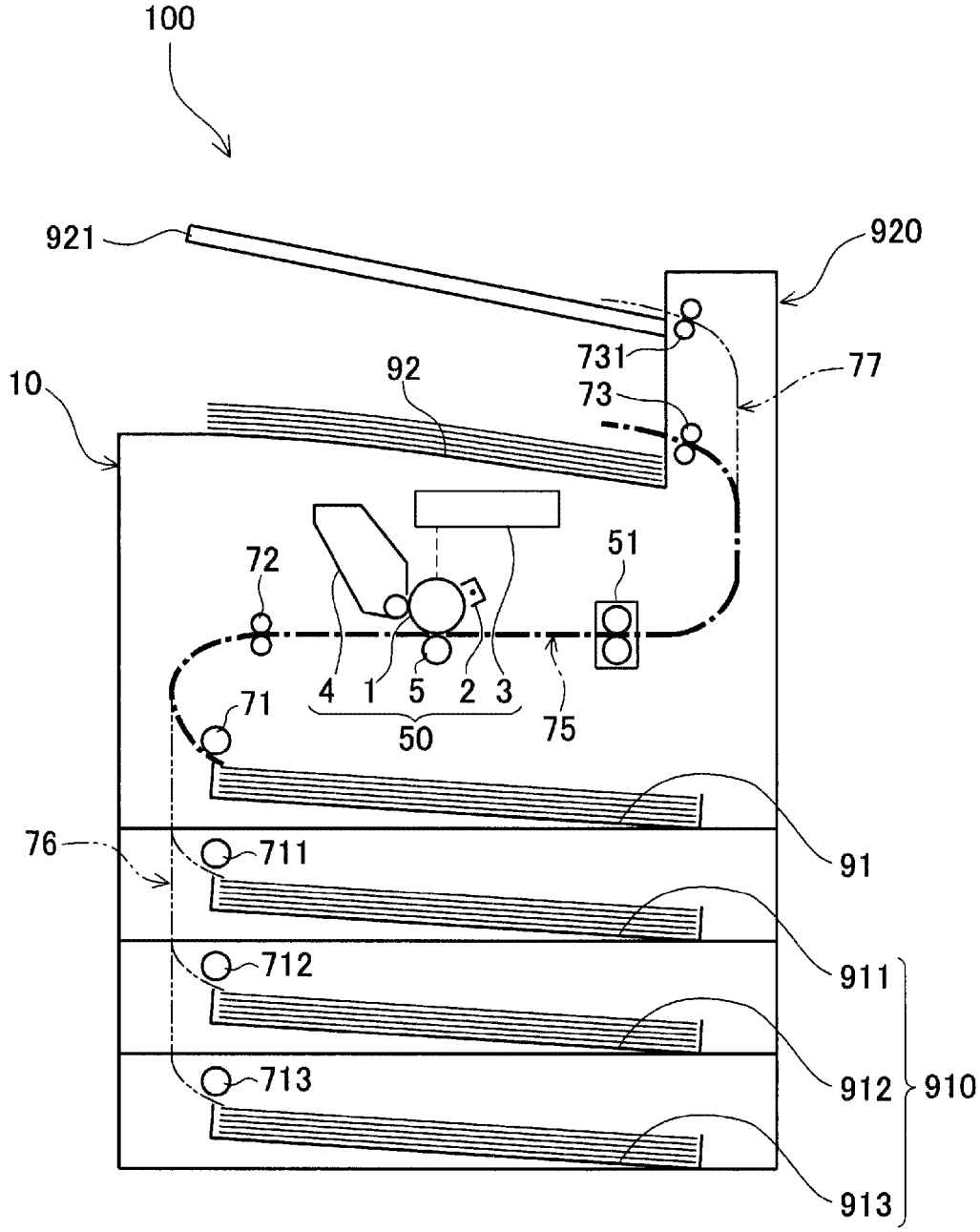
FIG. 2 is a sectional view showing an internal configuration of the printer shown in FIG. 1.

Subsequently, an internal configuration of the printer 100 is described with reference to FIG. 2. The main body unit 10 of the printer 100 has a process unit 50 (an example of a printing device) which forms a toner image by an electrophotographic method and transfers the toner image onto a sheet, a fixing device 51 which fixes toner, which has not been fixed yet after the transfer, on the sheet and various rollers (for example, a feeder roller 71, registration rollers 72, and sheet discharge rollers 73) which are used to convey the sheet. Also, the additional feeder unit 910 has a feeder roller 711 which picks up a sheet from the first optional sheet feeding tray 911, a feeder roller 712 which picks up a sheet from the second optional sheet feeding tray 912 and a feeder roller 713 which picks up a sheet from the third optional sheet feeding tray 913. Also, the additional sheet discharge unit 920 has sheet discharge rollers 731 which convey a sheet to the optional sheet discharge tray 921.

In the main body unit 10 of the printer 100, a conveyance path 75 (shown by the dashed-dotted line in FIG. 2) having a substantial S shape is formed such that the sheet accommodated in the normal sheet feeding tray 91 positioned at the bottom passes through the feeder roller 71, the registration rollers 72, the process unit 50, the fixing device 51 and the sheet discharge rollers 73 and is then guided to the normal sheet discharge tray 92.

Also, in the printer 100, a conveyance path 76 is formed such that the sheet before the printing is fed from the additional feeder unit 910 and is then guided to the process unit 50. Specifically, the sheet accommodated in the first optional sheet feeding tray 911 is guided to the conveyance path 76 by the feeder roller 711 and then joins the conveyance path 75. Also, the sheet accommodated in the second optional sheet feeding tray 912 is guided to the conveyance path 76 by the feeder roller 712 and then joins the conveyance path 75. The sheet accommodated in the third optional sheet feeding tray 913 is guided to the conveyance path 76 by the feeder roller 713 and then joins the conveyance path 75.

Also, in the printer 100, a conveyance path 77 is formed such that the sheet after the printing is conveyed to the additional sheet discharge unit 920 and is then guided to the optional sheet discharge tray 921. Specifically, the sheet which is branched from the conveyance path 75 and is then conveyed to the additional sheet discharge unit 920 via the conveyance path 77 is guided to the optional sheet discharge tray 921 by the sheet discharge rollers 731.

The process unit 50 forms a toner image by an electrophotographic method and includes a photosensitive body 1, a charger device 2 which uniformly charges a surface of the photosensitive body 1, an exposure device 3 which exposes the surface of the photosensitive body 1 to thus form an electrostatic latent image thereon, a developing device 4 which develops the electrostatic latent image by using toner and a transfer device 5 which transfers the toner image on the photosensitive body 1 to the sheet. The photosensitive body 1, the charger device 2 and the developing device 4 configure a process cartridge and are detachably mounted to the main body unit 10.

In the process unit 50, the surface of the photosensitive body 1 is uniformly charged by the charger device 2. Then, the surface of the photosensitive member is exposed by light emit from the exposure device 3, so that an electrostatic latent image of an image to be formed on the sheet is formed thereon. Then, the toner, which is a coloring agent, is supplied to the photosensitive body 1 through the fixing device 4. Thereby, the electrostatic latent image on the photosensitive body 1 becomes visible as a toner image.

The printer 100 picks up the sheet one by one accommodated in the sheet feeding tray which is designated in print data or the sheet feeding tray which is automatically selected by the printer 100 and then conveys the sheet to the process unit 50. Then, the printer transfers the toner image formed on the photosensitive body 1 of the process unit 50 to the sheet by the transfer device 5. Then, the printer 100 conveys the sheet having the toner image transferred thereto to the fixing device 51 and heat-fixes the toner image on the sheet. Then, the printer discharges the sheet after the fixing to the sheet discharge tray which is designated in the print data or the sheet discharge tray which is automatically selected by the printer 100.

[Electrical Configuration of Printer]

Figure 3:
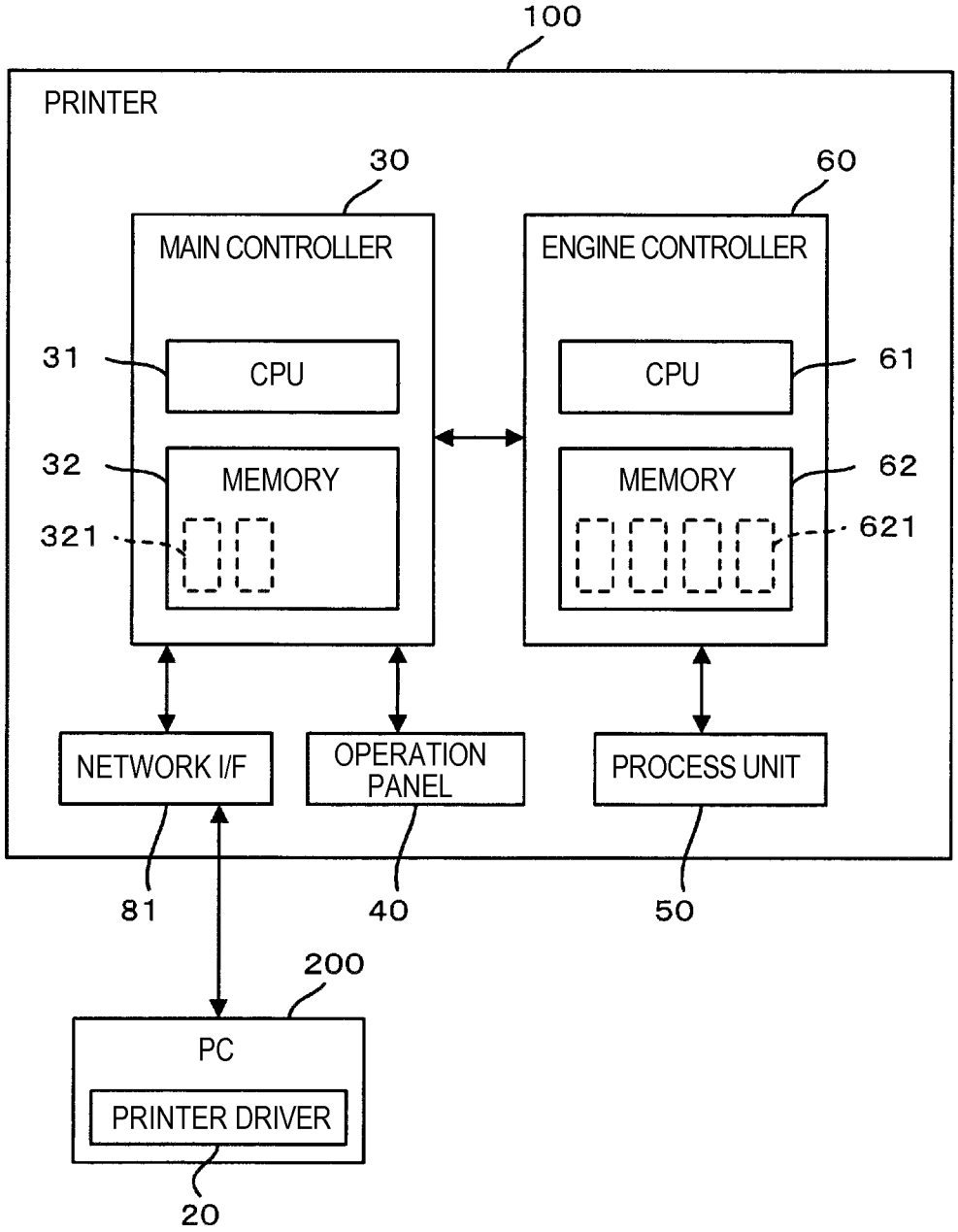
FIG. 3 is a block diagram showing an electrical configuration of the printer shown in FIG. 1.

Subsequently, the electrical configuration of the printer 100 is described. As shown in FIG. 3, the printer 100 has a main controller 30 (an example of a control device) which controls constitutional elements of the printer 100 except for the process unit 50 and an engine controller 60 which controls the process unit 50. The main controller 30 is electrically connected to a network interface 81, the operation panel 40, the main body unit 10, driving motors (not shown) for the various rollers, and the like. In the meantime, when the additional feeder unit 910 or additional sheet discharge unit 920 is mounted, the driving motors also drive rollers embedded therein.

Also, the main controller 30 has a CPU 31 and a memory 32. The CPU 31 executes calculations for implementing various functions of the printer 100 and functions as the center of the control. The memory 32 is used as a work area from which various control programs are read out or as a storage area in which the print data is temporarily stored.

The engine controller 60 has a CPU 61 and a memory 62 (an example of a storage device). The CPU 61 executes a calculation for implementing an image formation function of the process unit 50. The memory 62 is used as a work area from which various control programs are read out or as a storage area in which the print data is temporarily stored.

Memory areas in which the print data is stored in a print page unit are secured in advance in the memory 32 of the main controller 30 and the memory 62 of the engine controller 60. Specifically, in this illustrative embodiment, a memory area 321 of two pages is secured in the memory 32 and a memory area 621 of four pages is secured in the memory 62.

The network interface 81 is connected to a network such as internet and enables the printer to connect with an information processing apparatus such as personal computer (PC). The printer can transmit and receive the print data via the network interface 81. In this illustrative embodiment, the printer 100 is connected to a PC 200, in which a printer driver 20 for the printer 100 is installed, via the network interface 81 and receives the print data from the PC 200.

[First aspect]

[Control of Printer]

[Outline]

Subsequently, an outline of the control of the printer 100 is described. The printer 100 receives the print data in a print page unit and then stores the print data in the memory area 321 of the main controller 30. The main controller 30 performs various correction processing for the print data stored in the memory area 321.

The main controller 30 transfers the print data, which becomes a print object, to the engine controller 60 on a condition that there is an available area in the memory area 621 of the engine controller 60. The engine controller 60 stores the transferred print data in the memory area 621 and controls the process unit 50 to thus print an image.

When the printing is completed, the engine controller 60 enables the memory area 621, in which the print data for which the printing has been completed is stored, to be overwritten and thus to store next print data. When the engine controller 60 can store print data, the main controller 30 transfers print data of a next page. In other words, the main controller 30 defers transferring the print data of a next page until the engine controller 60 is enabled to store the print data therein. Also, the main controller 30 holds the print data until the sheet having the print data image printed thereon is discharged, so as to perform a recovery printing, and enables the memory area 321 storing the print data to be overwritten on a condition that the printed sheet has been discharged.

Also, in order to prevent an overrun, the main controller 30 starts feeding a sheet to be printed based on the print data on a condition that the print data is stored in the memory area 621 of the memory 62 of the engine controller 60. For example, until the print data of the fifth page has been stored in the memory area 621, the main controller 30 does not start feeding a sheet to be printed based on the print data of the fifth page.

Also, the main controller 30 controls the various rollers such that the sheet is moved along the conveyance path 75 by using the sheet feeding tray and sheet discharge tray designated in the print data. Alternatively, when the sheet feeding tray is not designated, the main controller 30 automatically selects the sheet feeding tray. Further alternatively, when the sheet discharge tray is not designated, the main controller 30 automatically selects the sheet discharge tray. In the meantime, the tray is designated by the printer driver 20 and the designation is transmitted from the printer driver 20 to the printer 100 together with the print data. Also, with the printer driver 20, it is possible to designate not only a specific tray but also an automatic selection option for entrusting designation of a tray to the printer 100.

When automatically selecting a sheet feeding tray or sheet discharge tray, the main controller 30 considers 'the maximum number of pages' that is the number of pages which can be stored in the memory area 621, and 'the maximum number of sheets' that is the number of sheets which can be conveyed simultaneously (i.e., the number of sheets which can remain in the conveyance path at a moment).

Specifically, for each combination of the sheet feeding tray and the sheet discharge tray, the maximum number of sheets is defined as shown in FIG. 4, and the printer 100 of this aspect stores the defined number of sheets as a maximum sheet number table. The maximum number of pages which can be stored in the memory area 621 is four (pages). Thus, for a combination having the maximum number of sheets of five (combinations dot-hatched in FIG. 4), it may not possible to perform the printing at a maximum speed.

That is, according to the printer 100 of this aspect, when printing the print data of five pages or more, a plurality of sheets remains in the conveyance path for a combination of the sheet feeding tray and the sheet discharge tray which have a long conveyance path with the maximum number of pages of five pages therein. As a result, the memory area 621 becomes full with four pages. In order to continue to perform the printing at a maximum speed, it is required that the storing of the next print data should be completed before the next sheet is fed. However, when the memory area 621 is full, the storing of the next print data may be delayed.

For example, for a combination having the maximum number of pages of five, the conveyance path is long and it takes time to complete printing. According to the above example, it is not possible to start storing the print data of the fifth page unless the printing of a first page is completed. Therefore, the storing completion of the print data of the fifth page is also delayed. Also, when a data size of the print data of the fifth page is large, it takes time to store the print data. That is, for a combination which has a high possibility that the memory area 621 will be entirely full, the starting of the sheet feeding, for example the feeding of the sheet subsequent to the fourth sheet is likely to be delayed. An intermittent sheet conveyance would occur when the starting of the sheet feeding is delayed. As a result, it is not possible to perform the printing at a maximum speed. Therefore, in order to avoid the above situation, the main controller 30 automatically selects a combination of the sheet feeding tray and the sheet discharge tray in which the maximum number of sheets is the maximum number of pages or smaller, so as to reduce the possibility that the memory area 621 will be entirely full.

Specifically, in this aspect, since the maximum number of pages is four, the main controller 30 selects a combination of the sheet feeding tray and the sheet discharge tray, in which the maximum number of sheets is four or smaller. For example, in a case that the optional sheet discharge tray 921 is designated as the sheet discharge tray, if the second optional sheet feeding tray 912 or the third optional sheet feeding tray 913 is selected, the maximum number of sheets becomes five. Thus, the main controller 30 selects the normal sheet feeding tray 91 or the first optional sheet feeding tray 911 configuring a combination (a combination shown with a thick border in FIG. 4) in which the maximum number of sheets is four.

In the meantime, the maximum sheet number table shown in FIG. 4 is a table which is used when the sheets held in these sheet feeding trays have the same size. For a printer which can handle various sheet sizes, maximum sheet number tables are prepared which are different for each sheet size.

[Print Control Processing]

Figure 5:
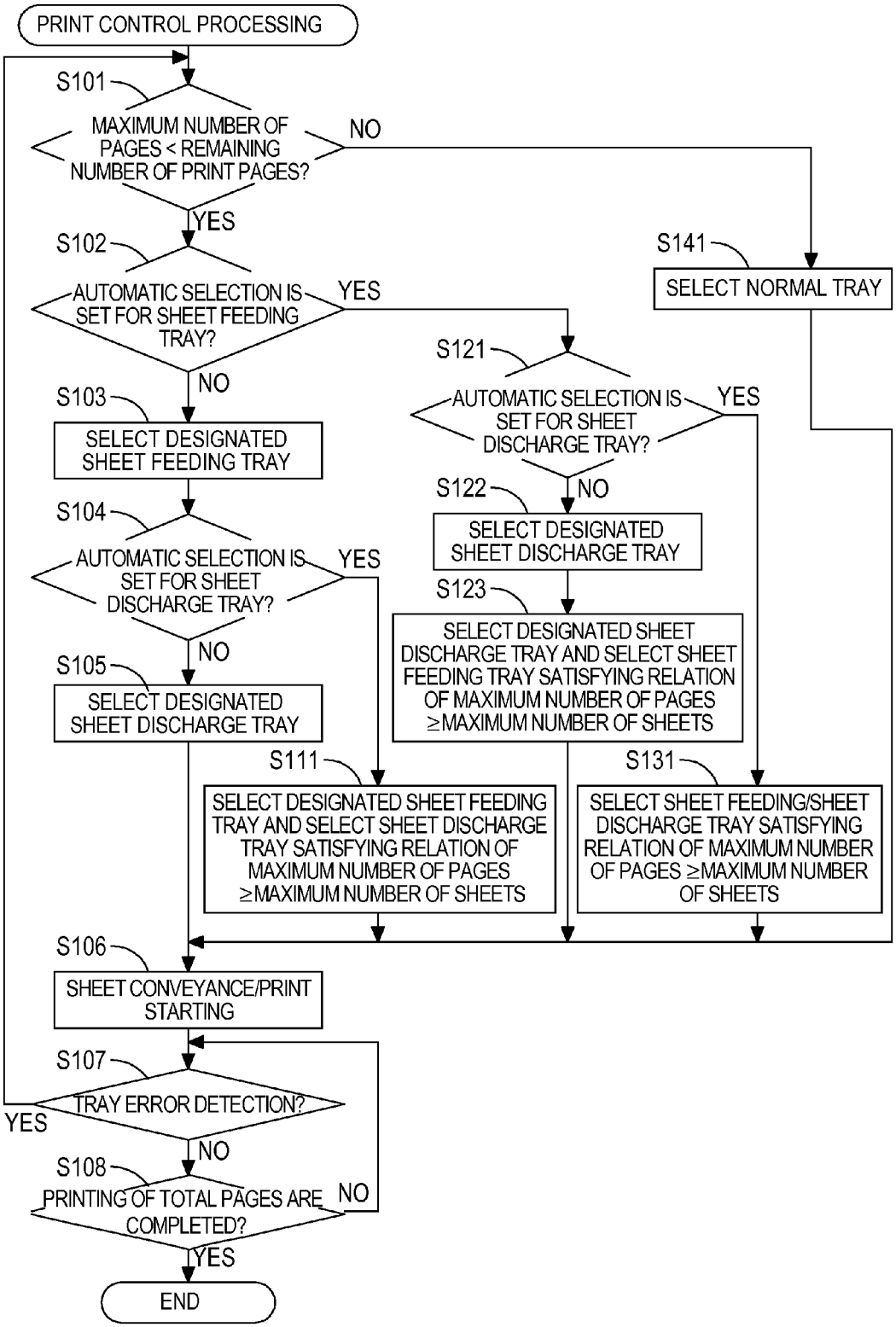
FIG. 5 is a flowchart showing a sequence of print control processing of the printer according to a first aspect.

Subsequently, the print control processing of implementing the automatic selection of the sheet feeding tray or sheet discharge tray is described with reference to a flowchart shown in FIG. 5. The print control processing is executed by the CPU 31 when the printer 100 receives the print data.

In the print control processing, the CPU 31 first determines whether the maximum number of pages that is the number of pages which can be stored in the memory area 621 is smaller than the remaining number of print pages, which is the number of pages of print data not printed yet (S101).

When the maximum number of pages is the remaining number of print pages or larger (S101: NO), the memory area 621 has an available area in which the print data for the remaining print pages can be stored and it is not necessary to wait for that the memory area 621 has an available area. Therefore, even with any combination of the trays, a standby situation for storing the print data into the memory area 621 is not likely to occur during the sheet conveyance. Thus, the CPU 31 performs normal tray selection (S141). In this aspect, when the sheet feeding tray or sheet discharge tray is designated, the CPU 31 selects the designated tray. For the automatic selection, the CPU 31 arbitrarily selects the tray. After S141, the process proceeds to S106.

When the maximum number of pages is smaller than the remaining number of print pages (S101: YES), a standby situation for storing the print data in the memory area 621 may occur during the sheet conveyance, depending on the combinations of the trays. Thus, the CPU 31 determines whether the automatic selection is set for the sheet feeding tray (S102). When the automatic selection is set for the sheet feeding tray (S102: YES), the CPU 31 also determines whether the automatic selection is set for the sheet discharge tray (S121).

When the automatic selection is also set for the sheet discharge tray (S121: YES), the CPU 31 selects a combination of the sheet feeding tray and the sheet discharge tray, in which the maximum number of pages≥the maximum number of sheets, by using the maximum sheet number table (refer to FIG. 4) (S131). For example, in the example of FIG. 4, the CPU 31 selects a combination other than the dot-hatched combinations. After S131, the process proceeds to S106.

When the sheet discharge tray is designated (S121: NO), the automatic selection is made only for the sheet feeding tray. Thus, regarding the sheet discharge tray, the CPU 31 selects the designated sheet discharge tray (S122). The CPU 31 uses the maximum sheet number table for the sheet feeding tray. Specifically, the CPU 31 selects the designated sheet discharge tray for the sheet discharge tray and selects the sheet feeding tray satisfying the relation of the maximum number of pages≥the maximum number of sheets (S123). After S 123, the process proceeds to S 106.

Back to S102, when the sheet feeding tray is designated (S102: YES), the CPU 31 selects the designated sheet feeding tray for the sheet feeding tray (S103). Then, the CPU 31 determines whether the automatic selection is set for the sheet discharge tray (S104).

When the automatic selection is set for the sheer discharge tray (S104: YES), the automatic selection is made only for the sheet discharge tray. Thus, the CPU 31 uses the maximum sheet number table for the sheet discharge tray. Specifically, the CPU 31 selects the designated sheet feeding tray for the sheet feeding tray and selects the sheet discharge tray satisfying the relation of the maximum number of pages≥the maximum number of sheets (S111). After S111, the process proceeds to S106.

When the sheet discharge tray is also designated (S104: NO), the CPU 31 selects the designated sheet discharge tray for the designated sheet discharge tray (S105). After S105, the process proceeds to S106.

In the meantime, when the printer 100 make a selection on at least one of the sheet feeding tray and the sheet discharge tray in S111, S123 and S131, a sheet feeding tray or sheet discharge tray for which an error is detected is excluded from selection candidates. That is, in S111, S123 and S131, the CPU 31 selects a usable sheet feeding tray and a usable sheet discharge tray. For the sheet feeding tray, the error may be a situation of no sheet. For the sheet discharge tray, the error may be a situation of full sheets. In addition, the failure of the feeder roller or sheet discharge roller would also be the error.

Also, when there is no proper combination in S111, S123 and S131, the CPU 31 may display an error message and interrupt the printing. Alternatively, the CPU 31 may select any sheet feeding tray (for example, a normal sheet feeding tray 91) and any sheet discharge tray (for example, a normal sheet discharge tray 92) and continue the printing.

After S105, S111, S123, S131 or S141, the CPU 31 conveys the sheet by using an execution sheet feeding tray which is the selected sheet feeding tray, and an execution sheet discharge tray which is the selected sheet discharge tray, and starts a printing operation (S106). That is, the main controller 30 transfers the print data to the engine controller 60, outputs a command for starting an image formation of the print data and starts conveying the sheet from the execution sheet feeding tray.

After S106, the CPU 31 determines whether an error is detected in the execution sheet feeding tray or execution sheet discharge tray (S107). When an error is detected (S107: YES), the CPU 31 returns to S101 and again selects an execution tray so as to switch the execution tray for which the error has been detected to another tray. In the meantime, when an error occurs in a newly designated tray, the CPU 31 may switch the same to a further different tray or interrupt the printing.

When an error is not detected (S107: NO), the CPU 31 determines whether the printing for the total page is completed at each time when the printing of one page is completed (S108). When there is a page which has not been printed (S108: NO), the CPU 31 returns to S107 and continues the printing. When the printing for the total pages is completed (S108: YES), the CPU 31 ends the print control processing.

When the printer 100 of the first aspect makes selection on at least one of the sheet feeding tray and the sheet discharge tray (S111, S123, S131), the printer 100 selects a combination of the sheet feeding tray and the sheet discharge tray, which satisfies the relation of the maximum number of pages≥the maximum number of sheets, by using the maximum sheet number table. Thereby, the sheet feeding delay, which is caused due to the standby situation for storing the print data into the memory area 621, is suppressed, so that it is possible to expect the printing at a maximum speed.

[Second aspect]

[Control of PC]

Subsequently, as a second aspect, an operation of the PC 200 transmitting the print data to the printer 100 is described. When a user sets for the print data, the PC 200 of this aspect enables the user to select a combination of the sheet feeding tray and the sheet discharge tray, which satisfies the relation of the maximum number of pages≥the maximum number of sheets. This is different from the first aspect in which the printer 100 selects the combination of the sheet feeding tray and the sheet discharge tray satisfying the above relation.

Figure 6:
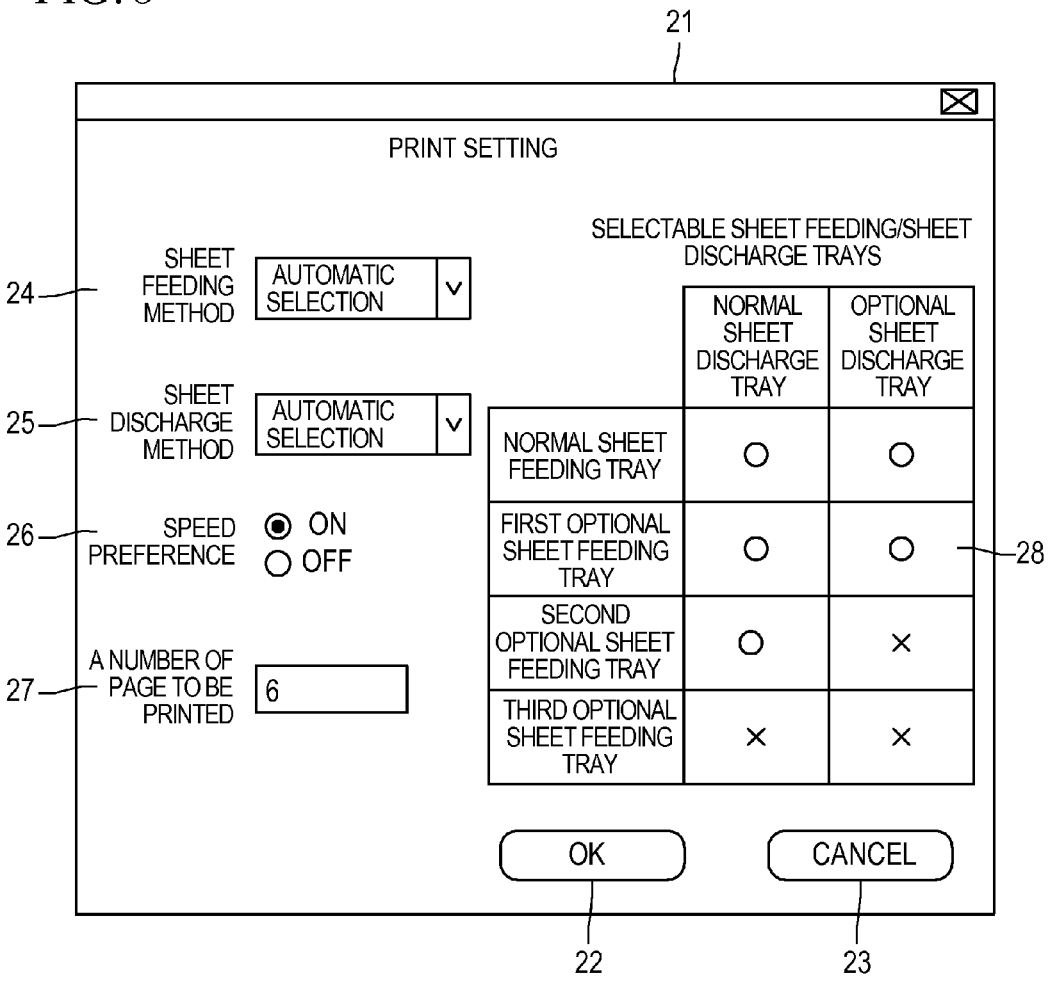
FIG. 6 shows a display example of a print setting window of a printer driver according to a second aspect.

When the user is allowed to set print settings, the PC 200 displays a print setting window 21 as shown in FIG. 6 by the printer driver 20. The print setting window 21 has an OK button 22 (an example of an instruction unit) for reflecting the set print settings for the print data, a cancel button 23 for cancelling the set print settings for print data, a sheet feeding selection part 24 (an example of a selection unit) for selecting a sheet feeding method, a sheet discharge selection part 25 (an example of a selection unit) for selecting sheet discharge method, a speed selection part 26 for setting whether printing speed has priority, a page setting part 27 for setting a number of page to be printed, and a table part 28 (an example of a selection unit) for displaying combinations of selectable sheet feeding trays and sheet discharge trays.

In the table part 28, a combination of the sheet feeding tray and the sheet discharge tray, which satisfies the relation of the maximum number of pages≥the maximum number of sheets, is shown with '○' and a combination of the sheet feeding tray and the sheet discharge tray, which does not satisfy the relation, is shown with 'x'. Thereby, a user can recognize a combination of the settable sheet feeding tray and the settable sheet discharge tray. Regarding the sheet feeding selection part 24 and the sheet discharge selection part 25, when the OK button 22 is clicked at a state where a combination shown with 'x' is selected, an error message is displayed to prompt the user to re-set the print settings.

The printer driver 20 stores the maximum number of pages of the printer 100 and the maximum number of sheets (which corresponds to the maximum sheet number table in FIG. 4) corresponding to the combinations of the sheet feeding trays and the sheet discharge trays, and determines and displays '○' or 'x' in accordance with the corresponding information. In the meantime, the information of the maximum number of pages and the maximum number of sheets may be inquired with and acquired from the printer 100 or from an external apparatus such as printer server. When inquiring with the printer 100, regarding the optional sheet feeding tray or optional sheet discharge tray, mounted states thereof may be also acquired from the printer and the display content may be changed based on the mounted states. Also, when inquiring with the printer 100, error states of each tray may be also acquired from the printer and the display content may be changed based on the error states.

The sheet feeding selection part 24 and the sheet discharge selection part 25 are to select the sheet feeding tray and the sheet discharge tray, respectively, and selection items thereof are stored by the printer driver 20. The 'automatic selection' of the selection items means that the printer 100 selects the sheet feeding tray or sheet discharge tray automatically. In the meantime, regarding the information of the optional sheet feeding tray or optional sheet discharge tray, mounted states thereof may be also inquired to the printer and the selection items may be changed based on the mounted states.

Figure 7:
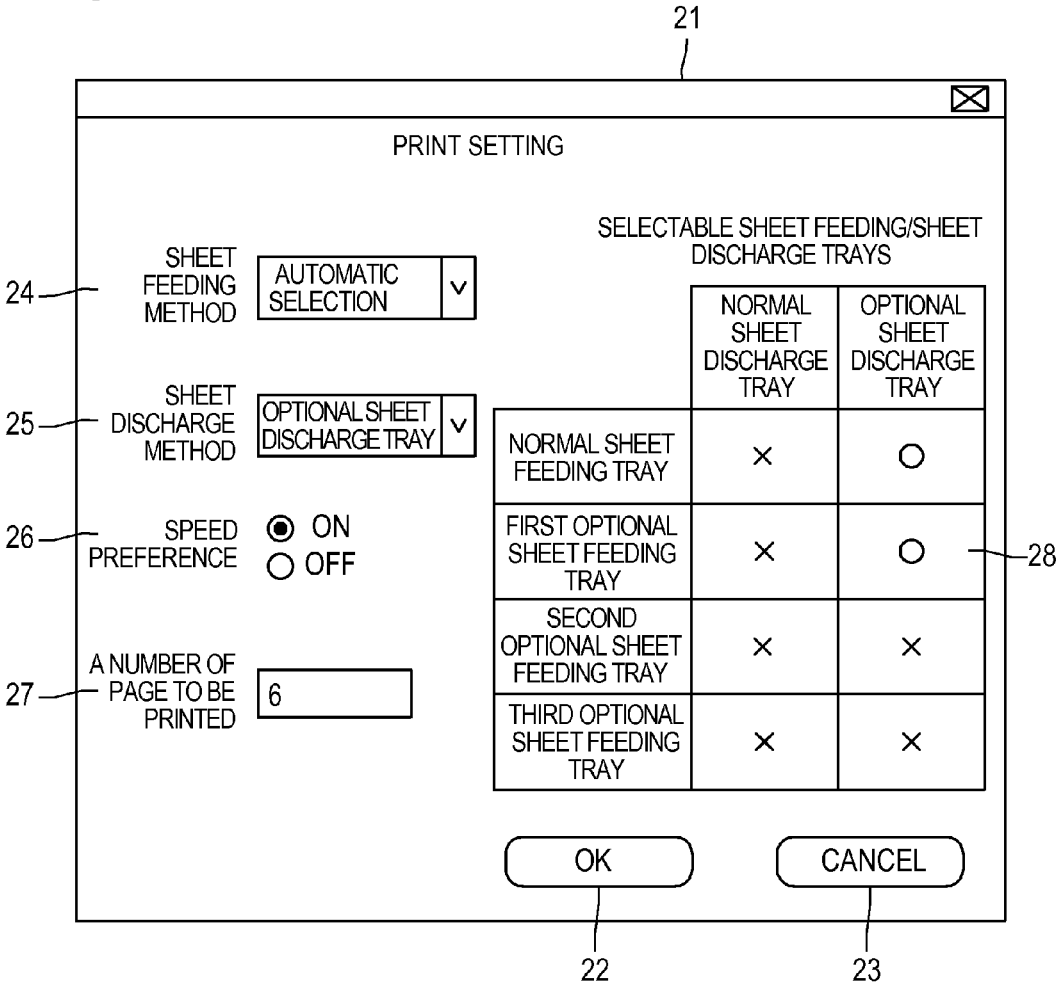
FIG. 7 shows a display example (when an option sheet discharge tray is selected) of the print setting window of the printer driver according to the second aspect.

Also, when the sheet feeding tray or sheet discharge tray is selected, in the display of the table part 28, all combinations that do not include the selected tray are changed to 'x', as shown in FIG. 7. Among the combinations that include the selected tray, when the sheet feeding tray is selected, the combinations of the selected sheet feeding tray and the sheet discharge tray satisfying the relation of the maximum number of pages<the maximum number of sheets are change to 'x'. As a result, only a combination of the selected sheet feeding tray and the sheet discharge tray satisfying the relation of the maximum number of pages≥the maximum number of sheets is selected. Similarly, when the sheet discharge tray is selected, a combination of the selected sheet discharge tray and the sheet feeding tray satisfying the relation of the maximum number of pages≥the maximum number of sheets is selected. For example, in FIG. 7, since the 'optional sheet discharge tray' is selected as the sheet discharge method, the combinations that do not include the optional sheet discharge tray and the combinations of the 'optional sheet discharge tray' and the sheet feeding tray satisfying the relation of the maximum number of pages<the maximum number of sheets are changed to 'x'. Thereby, it is possible to easily select a combination of the settable sheet feeding tray and sheet discharge tray.

Figure 8:
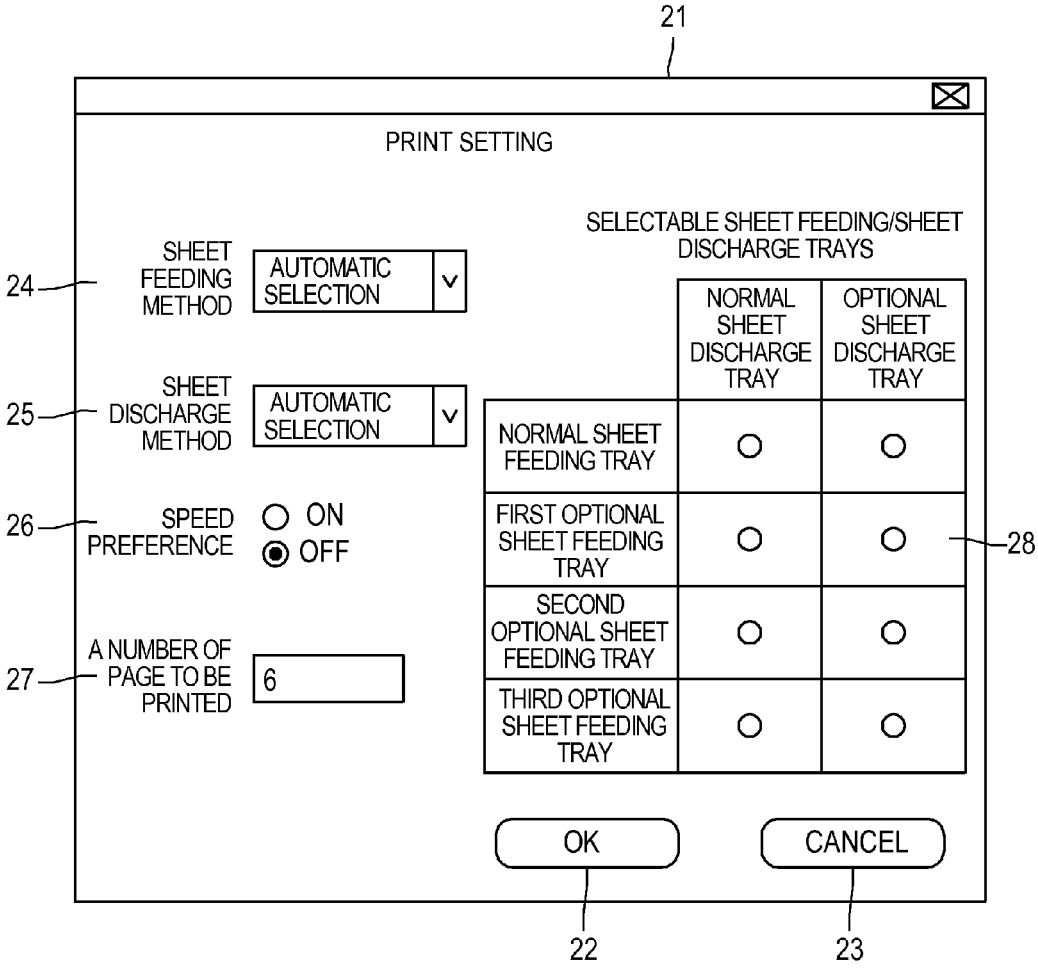
FIG. 8 shows a display example (when a speed preference setting is off) of the print setting window of the printer driver according to the second aspect.

When 'ON' is selected for the speed selection part 26, '○' is displayed only for a combination in the table part 28, with which the printing can be performed at a maximum speed. On the other hand, when 'OFF' is selected, '○' is displayed for all combinations even when the printing cannot be performed at a maximum speed but the printing can be performed, as shown in FIG. 8. Thereby, a degree of freedom of selection of the combination of the sheet feeding tray and the sheet discharge tray is improved.

In the second aspect, when the user sets the sheet feeding method and the sheet discharge method on the print setting window 21 of the printer driver 20, the PC 200 enables the user to select a combination of the sheet feeding tray and the sheet discharge tray satisfying the relation of the maximum number of pages≥the maximum number of sheets. Thereby, when the print data output from the PC 200 is printed with the printer 100, the sheet feeding delay, which is caused due to the standby situation for storing the print data into the memory area 621, is suppressed, so that it is possible to expect the printing at a maximum speed.

As specifically described above, the printer 100 of the illustrative embodiment feeds the sheet on a condition that the print data is stored in the memory area 621 of the memory 62 of the engine controller 60, thereby suppressing the overrun. Also, when making a selection on at least one of the sheet feeding tray and the sheet discharge tray, the printer 100 (or printer driver 20) selects the combination of the sheet feeding tray and the sheet discharge tray such that storing of the print data into the memory area 621 is completed by the conveyance starting time of the sheet for the print data by the maximum speed at the maximum number of sheets. Thereby, the conveyance delay of the sheet is suppressed, so that it is possible to expect the printing at a maximum speed.

In the meantime, the above illustrative embodiment is just exemplary and does not limit the invention. Accordingly, the invention can be variously improved and modified without departing from the gist of the invention. For example, the invention is not limited to the printer and can be applied to a device having a printing function such as copier, complex machine, FAX apparatus and the like. Also, the image forming method of the process unit 50 is not limited to the electrophotographic method and may be also an inkjet method. Also, a color image may be formed or only a monochrome image may be formed. Also, the apparatus having the printer driver 20 is not limited to the PC and can be applied to an apparatus having a printing instruction function, such as smart phone, PDA and the like.

Also, in the above illustrative embodiment, the main controller 30 controls the sheet conveyance. However, the engine controller 60 may control the sheet conveyance. That is, when the automatic selection is set for the sheet feeding tray or sheet discharge tray, the engine controller 60 may determine the execution sheet feeding tray or execution sheet discharge tray.

Also, in the above illustrative embodiment, the user selects the sheet feeding tray or sheet discharge tray from the PC 200 which is an external apparatus. However, the invention is not limited thereto. For example, even when the user selects the sheet feeding tray or sheet discharge tray from the operation panel 40 of the printer 100, it is possible to use the print setting window 21.

Also, in the above illustrative embodiment, two controllers of the main controller 30 and the engine controller 60 are provided. However, all control may be performed by one controller. In this case, the maximum number of pages is the number of pages which can be stored in a memory of the corresponding controller.

Also, in the above illustrative embodiment, when the printing is completed, the memory storing the print data is allowed to be overwritten, i.e., to store the next print data. However, when the discharge of the sheet having an image of the print data printed thereon is completed, the memory may be also allowed to store the next print data.

Also, in the above illustrative embodiment, the sheet feeding tray and the sheet discharge tray satisfying the relation of the maximum number of pages≥the maximum number of sheets are selected. However, when the conveyance delay of the sheet is not caused, the sheet feeding tray and the sheet discharge tray that do not satisfy the relation may be also selected. For example, the smaller the data size of the print data, the possibility that the sheet conveyance will be delayed is lowered. Therefore, when the data size of the print data is a predetermined threshold or smaller, the sheet feeding tray and the sheet discharge tray that do not satisfy the relation may be selected. Also, irrespective of the relation, the larger the data size of the print data, a combination of the sheet feeding tray and the sheet discharge tray, in which the maximum number of sheets is smaller, may be selected.

Also, in the above illustrative embodiment, when there exists plural combination of the sheet feeding tray and the sheet discharge tray, with which storing of the print data into the memory area 621 is completed by the conveyance starting time of the sheet to be printed based on the print data by the maximum speed at the maximum number of sheets, the printer 100 (printer driver 20) may make the selection based on a predetermined priority. For example, the combination of the sheet feeding tray and the sheet discharge tray, which has a shorter or longer conveyance path may be preferentially selected. Alternatively, the combination of the sheet feeding tray and/or the sheet discharge tray which has a larger or smaller capacity of sheet may be preferentially selected. Further, the combination of the sheet feeding tray and/or the sheet discharge tray which has a higher priority set in advance may be preferentially selected.

Also, the processing disclosed in the above illustrative embodiment may be executed by hardware such as a single CPU, a plurality of CPUs, an ASIC and the like or a combination thereof. Also, the processing disclosed in the above illustrative embodiment may be implemented in a variety aspects such as a recording medium having a program for executing the processing recorded therein, a method and the like.

What is claimed is:

1. A printing apparatus comprising:

a storage device including a storage area configured to store therein print data of a predetermined number of pages;

a sheet accommodation device including at least one sheet accommodation section configured to accommodate therein a plurality of sheets before printing;

a printing device configured to print an image on a sheet based on the print data stored in the storage area;

a discharged sheet accommodation device including at least one discharged sheet accommodation section configured to accommodate the sheet on which the image has been printed by the printing device;

a conveyance device configured to convey a sheet from the sheet accommodation device to the discharged sheet accommodation device via the printing device; and a control device configured to:

select an execution combination of a usable one of the at least one sheet accommodation section and a usable one of the at least one discharged sheet accommodation section such that the storage device completes storing print data into the storage area by a conveyance starting time of a sheet to be printed based on the print data, and not select a combination of one of the at least one sheet accommodation section and one of the at least one discharged sheet accommodation section, with which the storage device does not complete storing the print data into the storage area by the conveyance starting time of the sheet to be printed based on the print data, when making a selection on at least one of the sheet accommodation device and the discharged sheet accommodation device; and control the conveyance device to feed the sheet to be printed based on the print data from the sheet accommodation section of the selected execution combination to the discharged sheet accommodation section of the selected execution combination, on a condition that the storage device completes storing the print data in the storage area.

2. The printing apparatus according to claim 1, wherein a maximum number of serial sheets which can be conveyed by the conveyance device simultaneously varies depending on a combination of a sheet accommodation section and a discharged sheet accommodation section, and is represented by M (M is a natural number of one or larger), wherein a maximum number of pages, which is the predetermined number of pages which can be stored in the storage area of the storage device, is represented by N (N is a natural number of one or larger), and wherein the control device is configured to select, as the execution combination, a first combination of a sheet accommodation section and a discharged sheet accommodation section, for which the maximum number of sheets M is the maximum number of pages N or smaller.

3. The printing apparatus according to claim 2, wherein when the number of pages of the print data, which are not printed yet, is larger than the maximum number of pages N, the control device uses the first combination as a selection candidate, and wherein when the number of pages, which are not printed yet, is the maximum number of pages N or smaller, the control device uses the first combination and a combination other than the first combination as a selection candidate.

4. The printing apparatus according to claim 2, wherein the sheet accommodation device includes a plurality of sheet accommodation sections, wherein the control device is further configured to:

determine whether the sheet can be conveyed from, for each of the sheet accommodation sections;

switch an execution sheet accommodation section, from which a preceding sheet is being fed, to another usable one of the sheet accommodation sections to continue conveying the sheet when it is determined that the sheet cannot be conveyed from the execution sheet accommodation section, and select the first combination when the execution sheet accommodation section is switched.

5. The printing apparatus according to claim 4, wherein in a case where the execution sheet accommodation section is switched, when the number of pages of the print data, which are not printed yet, is larger than the maximum number of pages N, the control device uses the first combination as a selection candidate, and when the number of pages of the print data, which are not printed yet, is the maximum number of pages N or smaller, the control device uses the first combination and a combination other than the first combination as a selection candidate.

6. The printing apparatus according to claim 2, wherein the discharged sheet accommodation device includes a plurality of discharged sheet accommodation sections, wherein the control device is further configured to:

determine whether the sheet can be discharged to, for each of the discharged sheet accommodation sections;

switch an execution discharged sheet accommodation section, to which the preceding sheet is being discharged, to another usable one of the discharged sheet accommodation sections to continue conveying the sheet when it is determined that the sheet cannot be discharged to the execution discharged sheet accommodation section, and select the first combination when the execution discharged sheet accommodation section is switched.

7. The printing apparatus according to claim 6, wherein in a case where the execution discharged sheet accommodation section is switched, when the number of pages of the print data, which are not printed yet, is larger than the maximum number of pages N, the control device uses the first combination as a selection candidate, when the number of pages of the print data, which are not printed yet, is the maximum number of pages N or smaller, the control device uses the first combination and a combination other than the first combination as a selection candidate.

8. The printing apparatus according to claim 2, wherein when an execution sheet accommodation section, from which the sheet is being fed, is designated, the control device selects, as the execution combination, a combination of the execution sheet accommodation section and a usable one of the at least one discharged sheet accommodation section, for which that the maximum number of sheets M is the maximum number of pages N or smaller.

9. The printing apparatus according to claim 2, wherein when an execution discharged sheet accommodation section, to which the sheet is being discharged, is designated, the control device selects, as the execution combination, a combination of the execution discharged sheet accommodation section and a usable one of the at least one sheet accommodation section, for which the maximum number of sheets M is the maximum number of pages N or smaller.

10. The printing apparatus according to claim 1, wherein if there is no combination of a usable one of the at least one sheet accommodation section and a usable one of the at least one discharged sheet accommodation section, with which the storage device completes storing the print data into the storage area by the conveyance starting time of the sheet to be printed based on the print data, the control device controls the printing device to stop printing.

11. The printing apparatus according to claim 1, wherein if there is no combination of a usable one of the at least one sheet accommodation section and a usable one of the at least one discharged sheet accommodation section, with which the storage device completes storing the print data into the storage area by the conveyance starting time of the sheet to be printed based on the print data, the control device selects a combination of a predetermined usable one of the at least one sheet accommodation section and a predetermined usable one of the at least one discharged sheet accommodation section, as the execution combination.

12. A non-transitory storage medium having a computer program stored thereon and readable by a computer of a print control apparatus for controlling a printing apparatus, the computer program, when executed by the computer, causing the computer to operate as:

a selection unit configured to enable to select an execution combination of a usable one the at least one sheet accommodation section and a usable one of the at least one discharged sheet accommodation section such that the printing apparatus completes storing print data into a storage area of the printing apparatus by a conveyance starting time of a sheet to be printed based on the print data and disable to select a combination of one of the at least one sheet accommodation section and one of the at least one discharged sheet accommodation section, with which the printing apparatus does not complete storing the print data into the storage area by the conveyance starting time of the sheet to be printed based on the print data; and an instruction unit configured to instruct the printing apparatus to use the sheet accommodation section of the selected execution combination and the discharged sheet accommodation section of the selected execution combination.

* * * * *